US005233764A

United States Patent [19]

Vandergriff

[11] Patent Number: 5,233,764

[45] Date of Patent: Aug. 10, 1993

[54] TURBULENT AIRFLOW HOT SHELF TOWER DRYER

[75] Inventor: Arvel L. Vandergriff, Visalia, Calif.

[73] Assignee: William E. Winn, Levelland, Tex.

[21] Appl. No.: 860,761

[22] Filed: Feb. 7, 1992

[51] Int. Cl.[5] ..... F26B 3/08

[52] U.S. Cl. ..... 34/10; 34/57 R; 34/41

[58] Field of Search ..... 34/15, 57 R, 10, 39, 34/41; 126/247; 237/1 R; 19/0.27, 65 R

[56] References Cited

U.S. PATENT DOCUMENTS 3,075,514 1/1963 Paugh ..... 126/247

4,031,593 6/1977 Vandergriff .

4,143,470 3/1979 Vandergriff .

5,040,270 8/1991 Mackey .

*Primary Examiner*—Henry A. Bennet

*Attorney, Agent, or Firm*—Finnegan, Henderson, Farabow, Garrett & Dunner

[57] ABSTRACT

A tower dryer for seed cotton includes vertically spaced horizontal shelves which alternately extend from opposite ends of the tower dryer to form a zig-zag path. At least some of the shelves have hollow interiors which are supplied with heated air by two ducts at opposed positions across the hollow interior, thereby creating turbulent airflow within the hollow interior.

11 Claims, 3 Drawing Sheets

TURBULENT AIRFLOW HOT SHELF TOWER DRYER

BACKGROUND OF THE INVENTION

1. Field of the Invention

The present invention relates to a tower dryer for drying seed cotton, and more particularly relates to a tower dryer having hollow shelves provided with a heated turbulent airflow.

2. Description of the Related Art

Prior to ginning cotton, it is desirable to dry the cotton to remove excess moisture. Foreign matter is more easily removed when the cotton is in a fluffy condition, as usually occurs at five to six percent fiber moisture. At a low moisture content, the ginning process (the separation of the lint from the seed) is also greatly improved.

A tower dryer is frequently used to achieve such drying. In a tower dryer the cotton is exposed to and transported on shelves by a heated airstream. In a typical cotton gin, the seed cotton drying system is the first processing unit, and the cotton is delivered to a duct containing a heated airstream moving at a velocity of 4,000 to 5,000 feet per minute. The conveying air carries the cotton to an exposure chamber, which in this case is a parallel flow tower. The initial exposure of the cotton to heated air results in rapid moisture transfer to the air, resulting in a corresponding cooling of the drying air, due primarily to the cooling effect of evaporation. Initially, when the drying air temperature is high, the drying rate is high. As the air cools, the drying rate drops rapidly. In a conventional tower dryer, adequate drying is difficult to achieve in the few seconds of exposure time. Therefore, it is necessary to repeat the process through additional stages of drying.

In an effort to reduce the number of stages required for drying, it is common to raise the initial mix point temperature for the cotton in the drying air above a safe level, often in the range of 400° F. or higher. The sudden rise in temperature results in varying degrees of damage to the delicate cotton fibers. Fiber damage is becoming increasingly critical due to technological advances in textile mill processing.

It has been discovered that heating the shelves of the tower dryer over which the cotton is moving is desirable to achieve additional drying. Experience has shown that five to six BTU per square foot of surface can be transferred to the drying air for each degree of temperature difference across the shelf surface. U.S. Pat. No. 4,031,593, the disclosure of which is explicitly incorporated herein by reference, describes a relatively efficient tower dryer having heated shelves for drying seed cotton. Nonetheless, it is desirable to further enhance the efficiency of the drying process by increased heat transfer from the heated air to the seed cotton.

SUMMARY OF THE INVENTION

An object of the invention is to achieve an improved apparatus for drying seed cotton. Additional objects and advantages of the invention will be set forth in part in the description which follows, and in part will be obvious from the description, or may be learned by practice of the invention. The objects and advantages of the invention will be realized and attained by means of the elements and combinations particularly pointed in the appended claims.

To achieve the objects and in an accordance with the purposes of the invention, as embodied and broadly described herein, the invention includes a seed cotton drying apparatus comprising a cotton conveying channel, an air duct for conveying a heated airflow, the air duct adjacent to and in thermally conducting relationship with the cotton conveying channel, and means for generating turbulent airflow through the air duct.

As preferably embodied herein, the turbulent airflow generating means comprises a first supply duct in fluid communication with the air duct for supplying a first airflow to the air duct and a second supply duct in fluid communication with the air duct for supplying a second airflow, where the first and second supply ducts are positioned so that directions of the first airflow and the second airflow are divergent, and preferably opposed.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of the specification, illustrate an embodiment of the invention and together with the description serve to explain the principles of the invention.

DETAILED DESCRIPTION OF THE PREFERRED EMBODIMENT

Figure 1:
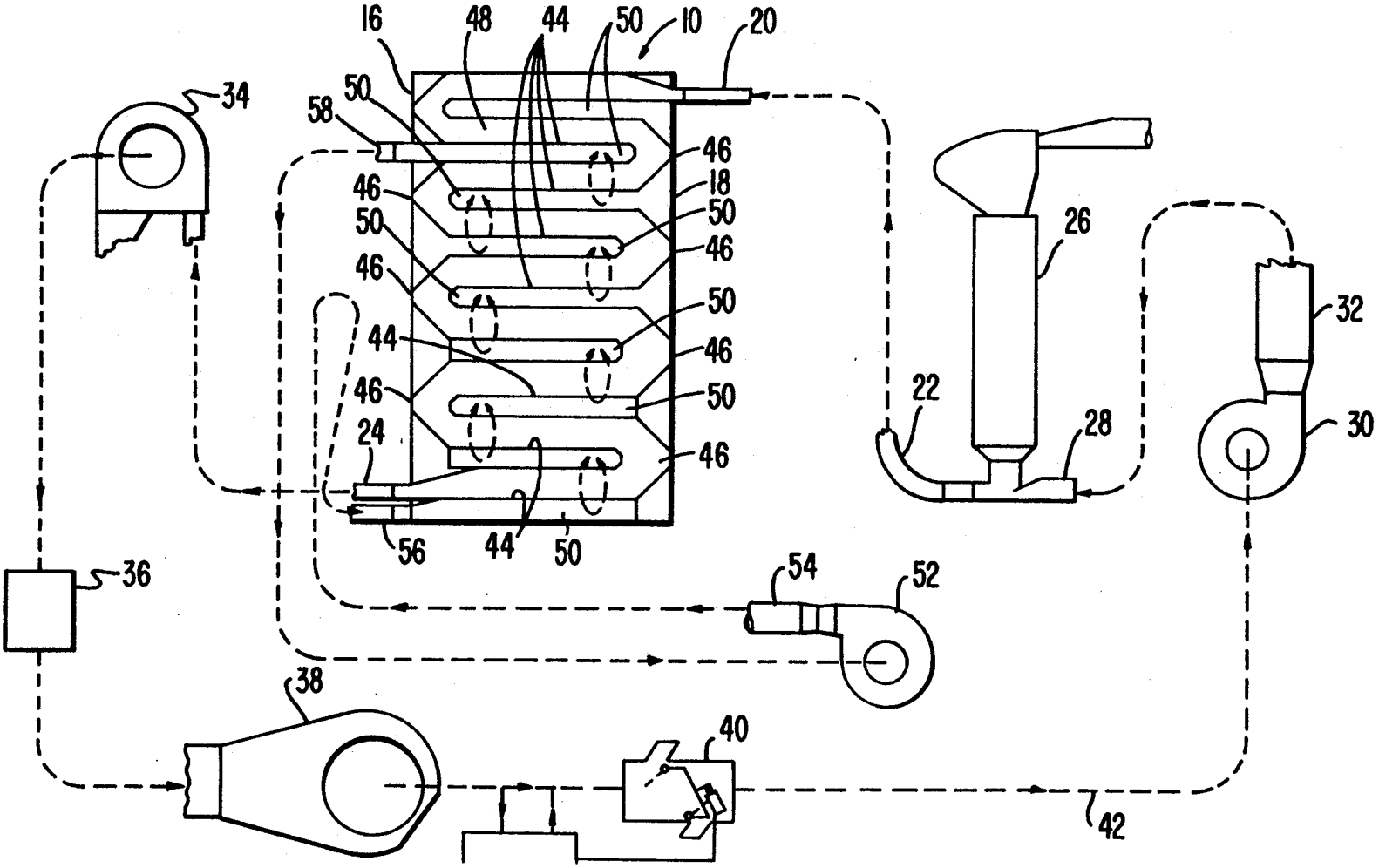
FIG. 1 is a schematic drawing of a cotton drying system incorporating the tower dryer of the invention.

Reference will now be made in detail to the presently preferred embodiment of the invention, an example of which is illustrated in the accompanying drawings. Wherever possible, the same reference numerals will be used throughout the drawings to refer to the same or like parts.

In accordance with the invention, a seed cotton dryer apparatus of the parallel flow tower type for conditioning seed cotton for ginning includes a vertically elongated drying tower casing having spaced apart vertically oriented lateral walls and front and rear sides and having an inlet adjacent the top for connection to an air duct through which seed cotton is pneumatically conveyed to receive cotton-conveying heated drying air and cotton conveyed by the drying air and having an air and cotton outlet adjacent the bottom.

Figure 2:
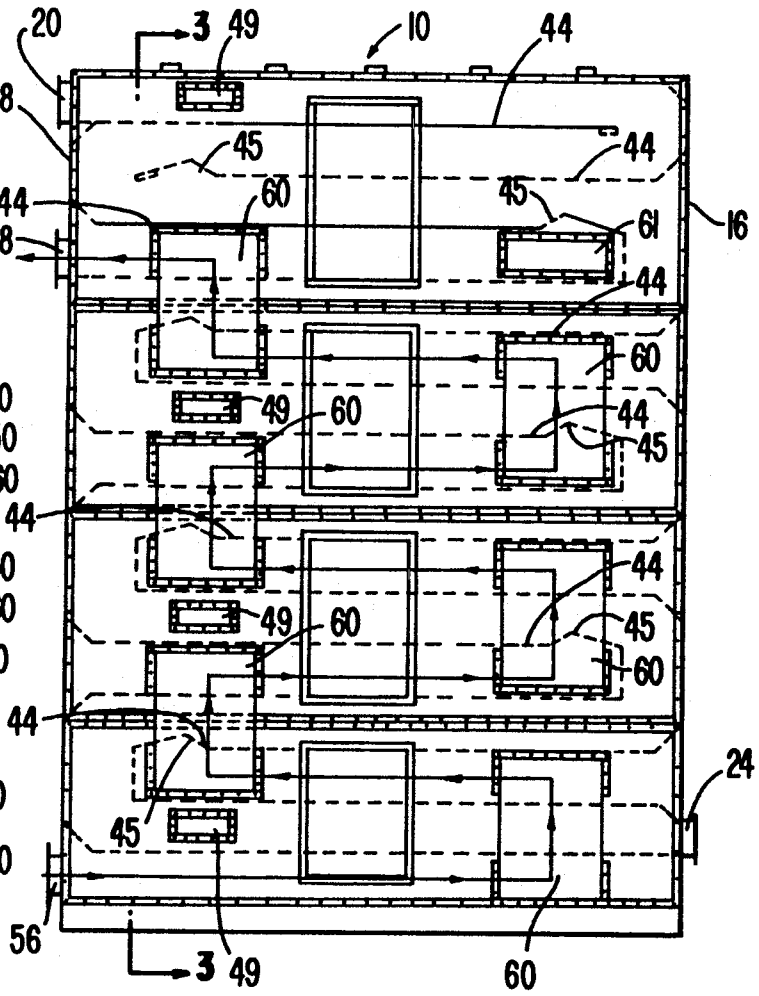
FIG. 2 is a side view of a tower dryer.
Figure 3:
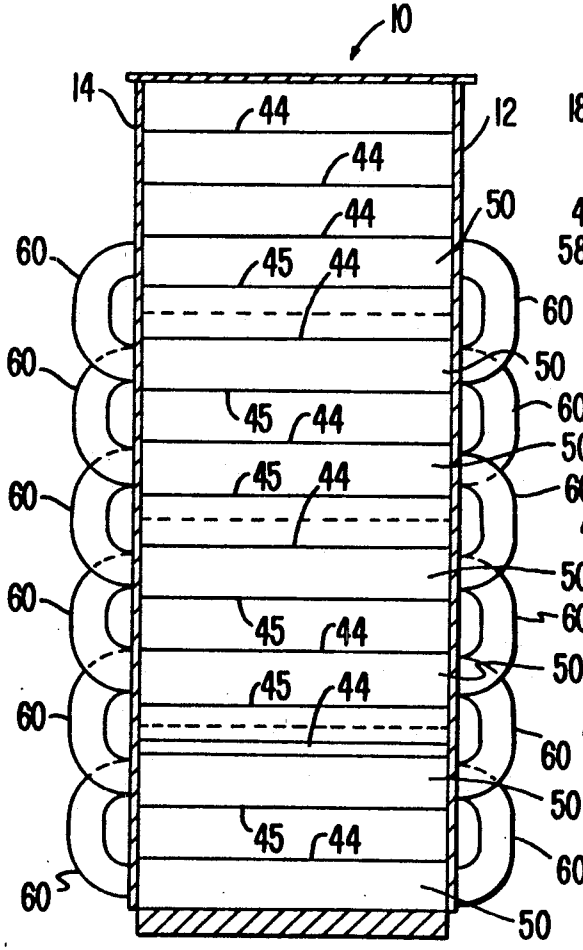
FIG. 3 is a view of the tower dryer of FIG. 2 taken from section 3—3.

As embodied herein, and shown in FIGS. 1-3, tower drying casing 10 has vertically-oriented lateral walls 12 and 14, and front and rear side walld 16, 18. Inlet 20 is adjacent the top of the casing 10 and connects to an air duct 22 through which seed cotton is pneumatically conveyed. Outlet 24 conveys dried cotton and air from the bottom of casing 10.

Preferably, the tower dryer is connected to feed control unit 26 which has air duct supplying portion 28 for introducing heated forced air into the cotton. Fan 30 and heater unit 32 provide the heated forced air.

Downstream of the tower dryer, a conventional revolving screen separator 34 may be provided to separate the seed cotton received from the tower dryer from the conveying air and discharge it through an associated vacuum dropper section to further cotton processing equipment. Return air is drawn by moisture pull fan 36 and propelled through air filter 38. Controlled fresh air intake valve 40 provides a controlled amount of fresh air into the recycled air-stream 42.

In accordance with the invention, a seed cotton dryer apparatus of the parallel flow tower type for conditioning seed cotton for ginning further includes a plurality of vertically spaced horizontal metal shelves fixed in the casing for providing flat horizontal upwardly facing metallic surfaces extending in horizontal planes between the lateral walls and spanning the width of the casing, the shelves from the uppermost to the lowermost, commencing alternatively from opposite front and rear sides of the casing and each terminating short of the side opposite its commencement, thereby defining a continuous zig-zag flowpath from the upper end to the lower end of the casing, communicating respectively with the inlet and outlet, the heated drying air and cotton conveyed thereby, being admitted to the upper end of the flow path at the inlet to be circulated through the flow path for evaporating moisture from the cotton while the drying air impels the cotton along the flow path.

As embodied herein, shelves 44 terminate short of opposite wall 46 to create the zig-zag flow pattern 48. Windows 49 may be provided to permit observation of the cotton in the flow pattern. Shelves 44 may be provided with ramps 45 at their ends. Ramps 45 serve to disperse the cotton in the airstream and enhance drying.

In accordance with the invention, a seed cotton dryer apparatus of the parallel flow tower type for conditioning seed cotton for ginning further includes a hollow interior in each of the metal shelves which form air ducts for conveying heated air to the surfaces of the shelves independent from the heated drying air, whereby the surfaces of the shelves can be heated substantially throughout their extent to diminish cooling of the heated drying air as it courses through the flow path.

As embodied herein, at least some of shelves 44 have hollow interiors 50 which can be manufactured by any conventional means. Hollow interiors 50 are provided with heated drying air provided by fan 52 and heater 54 which are fed into inlet 56 and returned from outlet 58. As can be seen in FIG. 2, the top two shelves are not provided with hollow interiors 50. This arrangement is due to the heated drying air having sufficient heat energy at this point of the flow path to provide adequate drying without additional heat transfer. However, all of the shelves may be provided with hollow interiors. Additional hollow shelves are particularly helpful if the drying air is unheated and heat is supplied only by heat transfer from shelves 44.

In accordance with the invention, a seed cotton dryer apparatus of the parallel flow tower type for conditioning seed cotton for ginning further includes a plurality of heated air conveying ducts interconnecting respective vertically adjacent hollow interiors of the shelves, the plurality of ducts arranged to create turbulent airflow in the respective one of said hollow interiors.

As embodied herein and shown in FIG. 3, two curved supply ducts 60 connect two adjacent hollow interiors 50. Curved ducts 60 are generally adjacent one end of the shelves 44 and are arranged in opposed relationship to each other across hollow interior such that two airflows exit from the lower hollow interior 50 and enter into the upper hollow interior 50 in opposed relationship to create turbulence within the hollow interior. The heated airflow then travels the length of the hollow interior of the shelf 44 until it reaches the next two ducts 60 where it is again transferred to the next adjacent hollow interior 50. Pairs of ducts 60 are preferably alternately located at opposite ends of hollow interiors of shelves 44.

As can be seen in the embodiment in FIG. 2, ducts 60 connect to the top hollow interior 50 proximate outlet 58. For this reason, the heated air entering the top hollow interior does not travel the length of the shelf. Alternatively, optional ducts 61 may be fitted to the tower dryer to act as an outlet instead of outlet 58. If optional ducts 61 are fitted, then heat transfer along shelf 44 corresponding to top hollow interior 50 can be enhanced.

Preferably, the tower dryer according to the invention is approximately six feet wide and twelve feet long, with shelves spaced twelve inches apart. However, the heat transfer area can be increased by making the tower wider, which would also require a larger column of air. Alternatively, the shelves could be made longer to increase the heat transfer. The variable shelf spacing and the primary air recirculating feature covered in U.S. Pat. No. 4,031,593 have the same advantage in the present invention.

Figure 4:
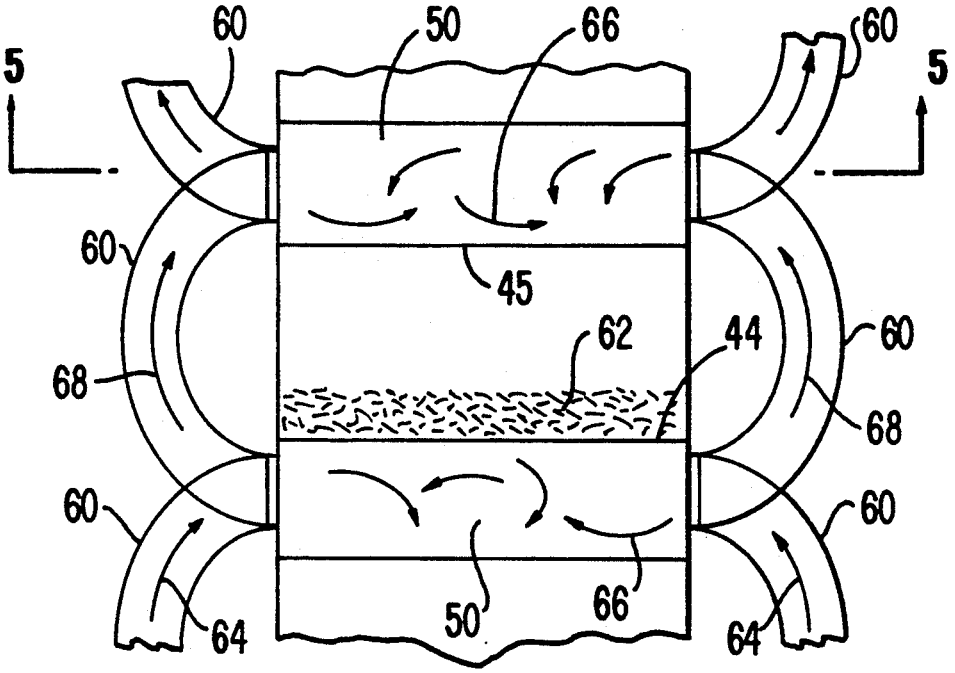
FIG. 4 is a schematic drawing of the heated airflow provided by this invention.
Figure 5:
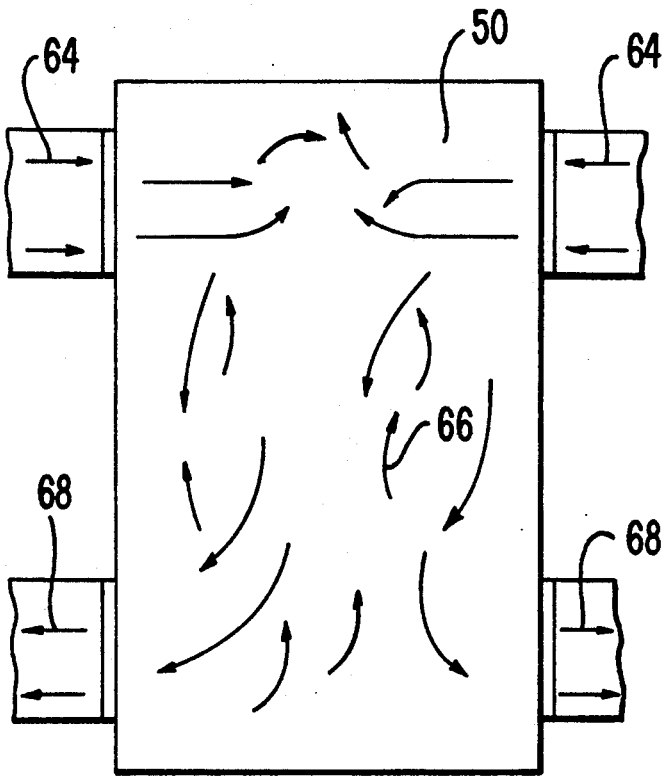
FIG. 5 is a schematic drawing of the airflow as viewed from section 5—5 of FIG. 4.

In operation, as shown in FIGS. 4 and 5, the seed cotton dryer discussed above improves the heat transfer to the surfaces of shelves 44, and thus also to the drying air and cotton 62 traveling over the surfaces of the shelves. The improved heat transfer is accomplished by causing the heated air (represented by arrows 64) to enter hollow interior 50 of shelves 44 at high velocity at each side, near the end of the shelf. The airflow from each side meets within the hollow interior and causes a violent turbulence in the chamber (indicated by arrows 66). The air then exits at the opposite end of the hollow interior through the duct on each side which redirects the air upward (see arrows 68) to the next hollow interior where the turbulent airflow is repeated. The heated airflow from the uppermost chamber is discharged into a duct which carries it back to the blower and heater where it can be recirculated through the system. Preferably, a small volume of fresh air is allowed to enter the airflow to provide oxygen for combustion by the heater.

The present invention yields an improved heat transfer from the hollow interiors of the shelves into the drying air so that the mix point temperature where the cotton and drying air are first introduced can be kept at a safe level which will not result in fiber damage, but at the same time, will add enough heat into the drying airstream as it travels through the tower dryer to keep the temperature at an efficient drying level.

In order to maintain a more efficient drying temperature throughout the zig-zag flow path, particularly to keep the drying air in the range of 180° F. to 200° F., hot air is introduced into the hollow interiors of the shelves to transfer heat to the drying air as it cools. This heat transfer is enhanced by the turbulent air created by the present invention.

The following description sets forth one example for the use of the invention. Incoming cotton has a moisture content of 16% and a fiber flow rate of 250 pounds per minute. Hot drying and conveying air is introduced with the cotton at 250° F. with an air volume of 12,000 cubic feet per minute, or about one pound of air per one pound of seed cotton. Early in the flow path the moisture level will have dropped to about 10% and the temperature will have dropped approximately 100° F. Approximately 60° F. to 70° F. of the temperature drop is attributable to evaporation of 15 pounds of moisture per minute and the remainder of the temperature drop is attributable to the heat exchange with the cotton mass and radiation losses.

Throughout the flow path, heat is transferred from the metal shelves 44 to the drying air. Additional heat is transferred to the drying air from surface 45 enclosing the hollow interior, which is positioned above the flow-path. The temperature of air within the first (lowermost) hollow interior 50 may be approximately 400° F. or above, but the temperature of the air is reduced as it is transferred upward from hollow interior to hollow interior. It is desirable to provide enough heat to keep the temperature of the drying air which is conveying the cotton above 200° F. during the time the cotton spends in the flow path. If this temperature can be maintained, by the time the cotton is discharged from the separating unit it will have reached a moisture level of approximately 6%. In order to achieve this result, it is desirable to supply the hollow interiors with air being blown by a blower having a capacity of 8,000 to 10,000 cubic feet per minute and a heating capacity of 1.5 million BTU.

It will be apparent to those skilled in the art that various modifications and variations can be made in the tower dryer of the present invention and in construction of this drying without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A seed cotton drying apparatus, comprising:

a cotton conveying channel;

an air duct for conveying a heated airflow, said air duct adjacent to and in thermally conducting relationship with said cotton conveying channel; and first and second supply ducts each in fluid communication with said air duct for supplying respective first and second air flows, said first and second supply ducts being positioned so that directions of said first air flow and said second air flow are divergent.

2. The apparatus of claim 1, wherein the air duct, first supply duct and second supply duct each have an axis along which their respective airflows travel, and wherein said first and second supply ducts are located such that the axes of their airflows are substantially orthogonal to the axis of the airflow of said air duct.

3. The apparatus of claim 2, wherein said second supply duct is arranged so that the axis of its airflow is substantially coincident with the axis of the airflow of the first supply duct and the directions of the respective airflows of said first and second supply ducts are substantially opposed.

4. The apparatus of claimed in claim 1, wherein sad turbulent airflow generating means includes a first exhaust duct in fluid communication with said air duct, said first exhaust duct located proximate an end of said air duct away from said first and second supply ducts.

5. The apparatus as claimed in claim 4, wherein said turbulent airflow generating means further includes a second exhaust duct in fluid communication with said air duct, said second duct being arranged in opposed relationship to said first duct.

6. A seed cotton dryer apparatus of the parallel flow tower type for conditioning seed cotton for ginning, the apparatus comprising:

a vertically elongated drying tower casing having spaced apart vertically oriented lateral walls and front and rear sides and having an inlet adjacent the top for connection to an air duct through which seed cotton is pneumatically conveyed to receive cotton-conveying heated drying air and cotton conveyed by the drying air and having an air and cotton outlet adjacent the bottom;

a plurality of vertically spaced horizontal metal shelves fixed in the casing providing flat horizontal upwardly facing metallic surfaces extending in horizontal planes between said lateral walls and spanning the width of the casing, said shelves from the uppermost to the lowermost commencing alternatively from opposite front and rear sides of the casing and each terminating short of the side opposite its commencement, thereby defining a continuous zig-zag flow path from the upper end to the lower end of the casing communicating respectively with said inlet and said outlet, the heated drying air and cotton conveyed thereby being admitted to the upper end of said flow path at said inlet to be circulated through said flow path for evaporating moisture from the cotton while the drying air impels the cotton along the flow path;

a hollow interior in at least two adjacent ones of said metal shelves for conveying heated air to the surfaces of the shelves independent from the heated drying air, whereby the surfaces of the shelves can be heated substantially throughout their extent to diminish cooling of the heated drying air as it courses through said flow path; and a plurality of heated air conveying ducts interconnecting respective vertically adjacent hollow interiors of said shelves, said plurality of ducts arranged to create turbulent airflow in said respective hollow interiors, wherein said plurality of heated air conveying ducts interconnecting a respective pair of vertically adjacent hollow interiors are horizontally spaced from said plurality of heated air conveying ducts interconnecting a successive pair of the vertically adjacent hollow interiors.

7. The apparatus of claim 6, further comprising:

a hot air feed duct connected to said hollow interior of the lowest of said vertically spaced shelves; and a return duct connected to the hollow interior of said highest shelf.

8. A method of drying seed cotton comprising the steps of:

conveying the cotton within a conveying channel using heated drying air;

injecting first and second heated air flows from first and second divergent directions through an air duct adjacent the conveying channel; and transferring heat from the additional heated air to the drying air.

9. The method, as claimed in claim 8, wherein the substep of injecting the second heated airflow injects the second airflow from the second direction so that it is opposed to said first direction.

10. The method, as claimed in claim 8, further comprising the substeps of:

removing a third airflow from said duct in a third direction; and removing a fourth airflow from said duct in a fourth direction which diverges from the third direction.

11. The method, as claimed in claim 10, wherein the substep of removing the fourth airflow removes the fourth airflow in the fourth direction so that it is opposed to the third direction.

* * * * *